US012467677B2

(12) United States Patent
Yun

(10) Patent No.: US 12,467,677 B2
(45) Date of Patent: Nov. 11, 2025

(54) REFRIGERATOR

(71) Applicant: LG ELECTRONICS INC., Seoul (KR)

(72) Inventor: Yeongsu Yun, Seoul (KR)

(73) Assignee: LG Electronics Inc., Seoul (KR)

( * ) Notice: Subject to any disclaimer, the term of this patent is extended or adjusted under 35 U.S.C. 154(b) by 379 days.

(21) Appl. No.: 18/102,384

(22) Filed: Jan. 27, 2023

(65) Prior Publication Data

US 2023/0243569 A1 Aug. 3, 2023

(30) Foreign Application Priority Data

Jan. 28, 2022 (KR) ..... 10-2022-0013492

(51) Int. Cl.
*F25D 17/06* (2006.01)
*F25C 1/00* (2006.01)
*F25D 17/08* (2006.01)

(52) U.S. Cl.
CPC ..... *F25D 17/065* (2013.01); *F25C 1/00* (2013.01); *F25D 17/067* (2013.01); *F25D 17/08* (2013.01); *F25C 2400/10* (2013.01); *F25D 2201/14* (2013.01); *F25D 2317/061* (2013.01); *F25D 2317/0671* (2013.01); *F25D 2317/0672* (2013.01)

(58) Field of Classification Search
CPC ..... F25D 17/065; F25D 17/067; F25D 17/08; F25D 2201/14; F25D 2317/061; F25D 2317/0671; F25D 2317/0672; F25D 23/02; F25C 1/00; F25C 2400/10
See application file for complete search history.

(56) References Cited

U.S. PATENT DOCUMENTS

2011/0146331 A1* 6/2011 Moon ..... F25C 1/04 62/449
2021/0262718 A1* 8/2021 Burlingham ..... F25D 17/065

* cited by examiner

*Primary Examiner* — Miguel A Diaz
(74) *Attorney, Agent, or Firm* — Fish & Richardson P.C.

(57) ABSTRACT

A refrigerator includes a refrigerator case, a freezer case disposed below the refrigerator case, a door disposed at a front of the refrigerator case, an ice maker disposed at the door, an evaporator disposed at a rear of the freezer case, an ice maker supply duct supplying the cold air to the ice maker, and an ice maker return duct supplying the cold air from the ice maker to the freezer compartment. An upper portion of the ice maker return duct extends from a rear of one side surface of the freezer case to a front of one side surface of the refrigerator case, a lower portion of the ice maker return duct extends in a vertical direction from the rear of one side surface of the freezer case, and the lower portion bends from the upper portion toward the other side surface of the freezer case.

20 Claims, 10 Drawing Sheets

REFRIGERATOR

CROSS-REFERENCE TO RELATED APPLICATION

This application claims priority to and the benefit of Korean Patent Application No. 10-2022-0013492, filed on Jan. 28, 2022, the disclosure of which is incorporated herein by reference in its entirety.

TECHNICAL FIELD

Disclosed herein is a refrigerator, and in particular, a refrigerator in which the size of a vacuum insulator is minimized.

BACKGROUND

Refrigerators are used to store various types of food items by using cold air that is generated based on the circulation of refrigerants in a refrigeration cycle.

A refrigerator is provided with a single storage compartment or a plurality of storage compartments that are divided, to refrigerate and store a storage target. At this time, the storage compartment can be a storage compartment that is opened and closed by a rotary door or is drawn or stored like a drawer.

In particular, the storage compartment can include a freezer compartment for keeping a storage target frozen, and a refrigerator compartment for keeping a storage target cold, and can include two or more freezer compartments or two or more refrigerator compartments.

Additionally, in recent years, an ice maker is provided at a door of the refrigerator, such that the user can take out ice without opening the freezer compartment. A duct for the ice maker delivers and returns cold air having passed through an evaporator in a cabinet ice maker until the cold air reaches the door of the refrigerator compartment, and if the door of the refrigerator compartment is closed, the duct for the ice maker supplies the cold air to the ice maker through a connection flow path provided at the door of the refrigerator compartment.

The duct is disposed on a side surface of the refrigerator compartment and/or the freezer compartment, and contacts an outer case closely. To prevent the formation of dew on the outer case, a vacuum insulator is disposed between the duct and the outer case. However, since the vacuum of a more expensive and bigger vacuum insulator is easily damaged, it would be better to reduce the use of the vacuum insulator.

SUMMARY

Technical Problems

The objective of the present disclosure is to provide a refrigerator in which a duct that supplies cold air to an evaporator disposed at a door of the refrigerator and returns cold air from the evaporator is efficiently disposed, to minimize the size of a vacuum insulator.

Aspects according to the present disclosure are not limited to the above ones, and other aspects and advantages that are not mentioned above can be clearly understood from the embodiments set forth herein. Additionally, the aspects and advantages in the present disclosure can be realized via components and combinations thereof that are described in the appended claims.

Technical Solutions

A refrigerator of an embodiment comprises a refrigerator case forming a refrigerator compartment, a freezer case being disposed at a lower side of the refrigerator case and forming a freezer compartment, a door being disposed at a front of the refrigerator case, and opening and closing the refrigerator case, an ice maker being disposed at the door and generating ice, an evaporator being disposed at a rear of the freezer case and generating cold air, an ice maker supply duct supplying the cold air that is generated by the evaporator to the ice maker, and an ice maker return duct supplying the cold air that is supplied to the ice maker to the freezer compartment, and an upper portion of the ice maker return duct crosses from a rear of one side surface of the freezer case to a front of one side surface of the refrigerator case and is disposed diagonally, a lower portion of the ice maker return duct is elongated and formed in a vertical direction from the rear of one side surface of the freezer case, and the lower portion bends from the upper portion toward the other side surface of the freezer case and has a fault shape.

A refrigerator of an embodiment comprises an outer case forming an exterior of the refrigerator, a refrigerator case being disposed in the outer case and forming a refrigerator compartment, a freezer case being disposed at a lower side of the refrigerator case in the outer case and forming a freezer compartment, a door being disposed at a front of the refrigerator case, and opening and closing the refrigerator case, an evaporator being disposed at a rear of the freezer case and generating cold air, an ice maker being disposed at the door, being supplied with the cold air that is generated by the evaporator, and generating ice, an ice maker return duct supplying the cold air that is supplied to the ice maker to the freezer compartment, and a vacuum insulator being disposed between a portion of the ice maker return duct and the outer case, and a portion of the ice maker return duct, in which the vacuum insulator is disposed, is closer to the outer case than a portion of the ice maker return duct, in which the vacuum insulator is not disposed.

Particulars of another embodiment are included in the detailed description and the drawings.

Advantageous Effects

A refrigerator according to the present disclosure has one or more of the following effects.

First, a portion of a duct, which is in contact with an outer case, is minimized, thereby minimizing the use of a vacuum insulator and reducing costs.

Second, the space of a freezer compartment or a refrigerator compartment is not reduced even though the duct bends and is spaced from the outer case.

Third, the duct bends three dimensionally, to minimize the bend and the use of a vacuum insulator, and no to affect the flow of cold air.

Advantages of the subject matter of the present disclosure are not limited to the advantages described above, and other advantages that are not mentioned above can be clearly understood by one having ordinary skill in the art, based on the details of the appended claims.

BRIEF DESCRIPTION OF DRAWINGS

The accompanying drawings constitute a part of the specification, illustrate one or more embodiments in the disclosure, and together with the specification, explain the disclosure.

DETAILED DESCRIPTION

Figure 1:
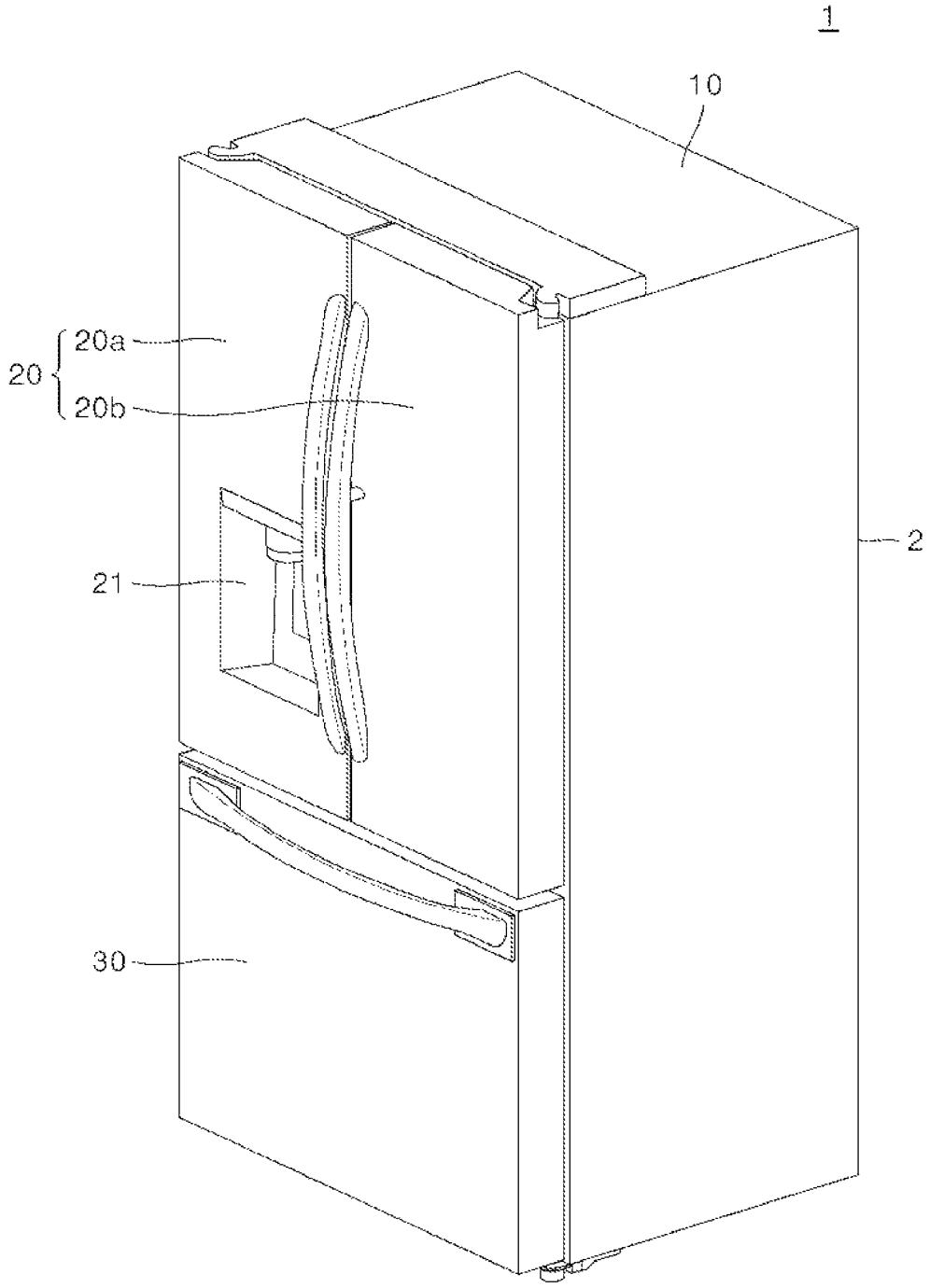
FIG. 1 is a front perspective view showing an example of a refrigerator.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

Throughout the disclosure, each component can be provided as a single one or a plurality of ones, unless explicitly stated to the contrary.

When any one component is described as being "in the upper portion (or lower potion)" or "on (or under)" another component, any one component can be directly on (or under) another component, but an additional component can be interposed between any one component and another component on (or under) any one component.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the phrase "A and/or B" as used herein can denote A, B or A and B, and the phrase "C to D" can denote C or greater and D or less, unless stated to the contrary.

Hereafter, an example of a refrigerator is described.

Figure 2:
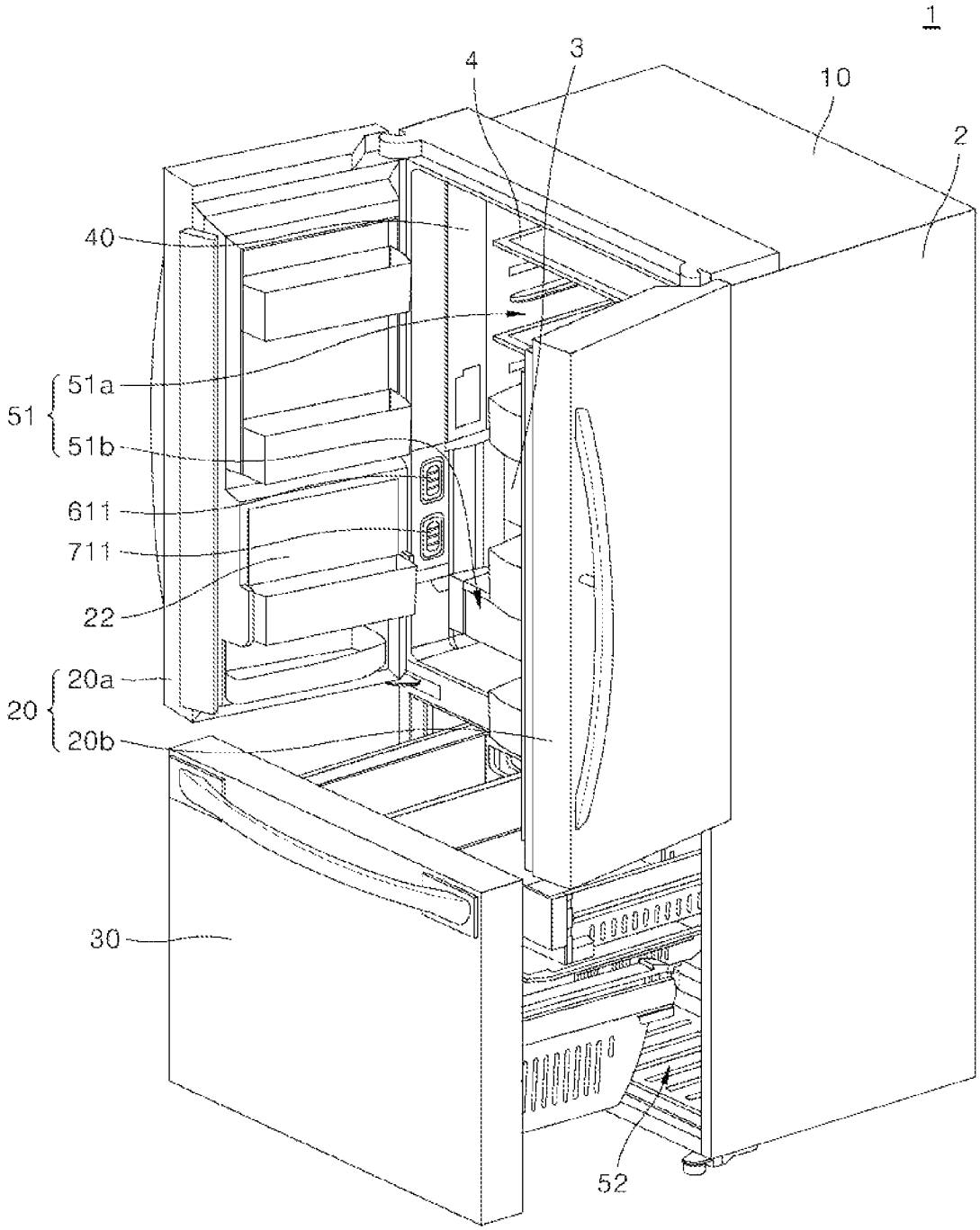
FIG. 2 is a front perspective view showing the refrigerator with doors being open.

FIG. 1 is a front perspective view showing an example of a refrigerator, and FIG. 2 is a front perspective view showing the refrigerator with doors open.

The exterior of the refrigerator 1 may be formed by a cabinet 2 that can form a storage space, and doors that can open and close an open front surface of the cabinet 2.

The cabinet 2 may comprise an outer case 10 forming the exterior of the refrigerator 1, and an inner case 40 forming the interior of the refrigerator 1.

The outer case 10 and the inner case 40 may have a separation space therebetween, and a foam insulator foams in the separation space, such that the separation space is filled with the foam insulator.

The storage space in the cabinet 2 may be divided into a plurality of spaces, and may be divided into a refrigerator compartment 51 and a freezer compartment 52.

According to the present disclosure, a freezer compartment 52 is disposed in the lower space of the cabinet 2, and a refrigerator compartment 51 is disposed in the upper space of the cabinet 2, in an example.

A door may connect to the front surface of the cabinet 2, and open and close the refrigerator 1.

An upper door 20 may be disposed on the front surface of the refrigerator 1, corresponding to the refrigerator compartment 51, and a lower door 30 may be disposed on the front surface of the refrigerator 1, corresponding to the freezer compartment 52.

For example, the upper door 20 may be a rotary type one comprised of a first upper door 20*a* and a second upper door 20*b* that respectively have a rotation axis at both sides of the cabinet 2 and rotate around the rotation axis.

The lower door 30 may be a drawer type one that moves along a rail in a sliding manner, to be drawn or stored.

A dispenser part 21 may be disposed at the first upper door 20*a* to take out water or ice, without opening the door. An ice maker 22 generating ice is disposed at the first upper door 20*a* at which the dispenser part 21 is disposed.

Additionally, a supply duct outlet 611 supplying cold air to the ice maker 22, and a return duct inlet 711 returning cold air of the ice maker 22 may be disposed at one surface of the inside of the inner case 40 that connects to the first upper door 20*a*. The supply duct outlet 611 and the return duct inlet 711 may communicate with one side surface of the ice maker 22, with the first upper door 20*a* closed.

The refrigerator compartment 51 may be divided into a first storage compartment 51*a* and a second storage compartment 51*b*.

The second storage compartment 51*b* may be a pantry compartment where a temperature can be adjusted to accommodate a specific storage object such as vegetables or meat and the like.

The first storage compartment 51*a* may denote the rest space of the refrigerator 51, except for the second storage compartment 51*b*, and may be a main storage comportment.

For example, the second storage compartment 51*b* may be disposed under the first storage compartment 51*a*, and as an additional space, may be separated from the first storage compartment 51*a* by an additional partition member.

A storage drawer 3 may be disposed in the second storage compartment 51*b*, and move along a rail in a sliding manner to be drawn or stored.

Additionally, a storage drawer 3 or a shelf 4 is provided in the first storage compartment 51*a*, and accommodate and store a storage object easily.

The first storage compartment 51*a* and the second storage compartment 51*b* may be respectively provided with a temperature sensor, and their temperature may be adjusted independently such that first storage compartment 51*a* and the second storage compartment 51*b* have a different temperature.

Figure 3:
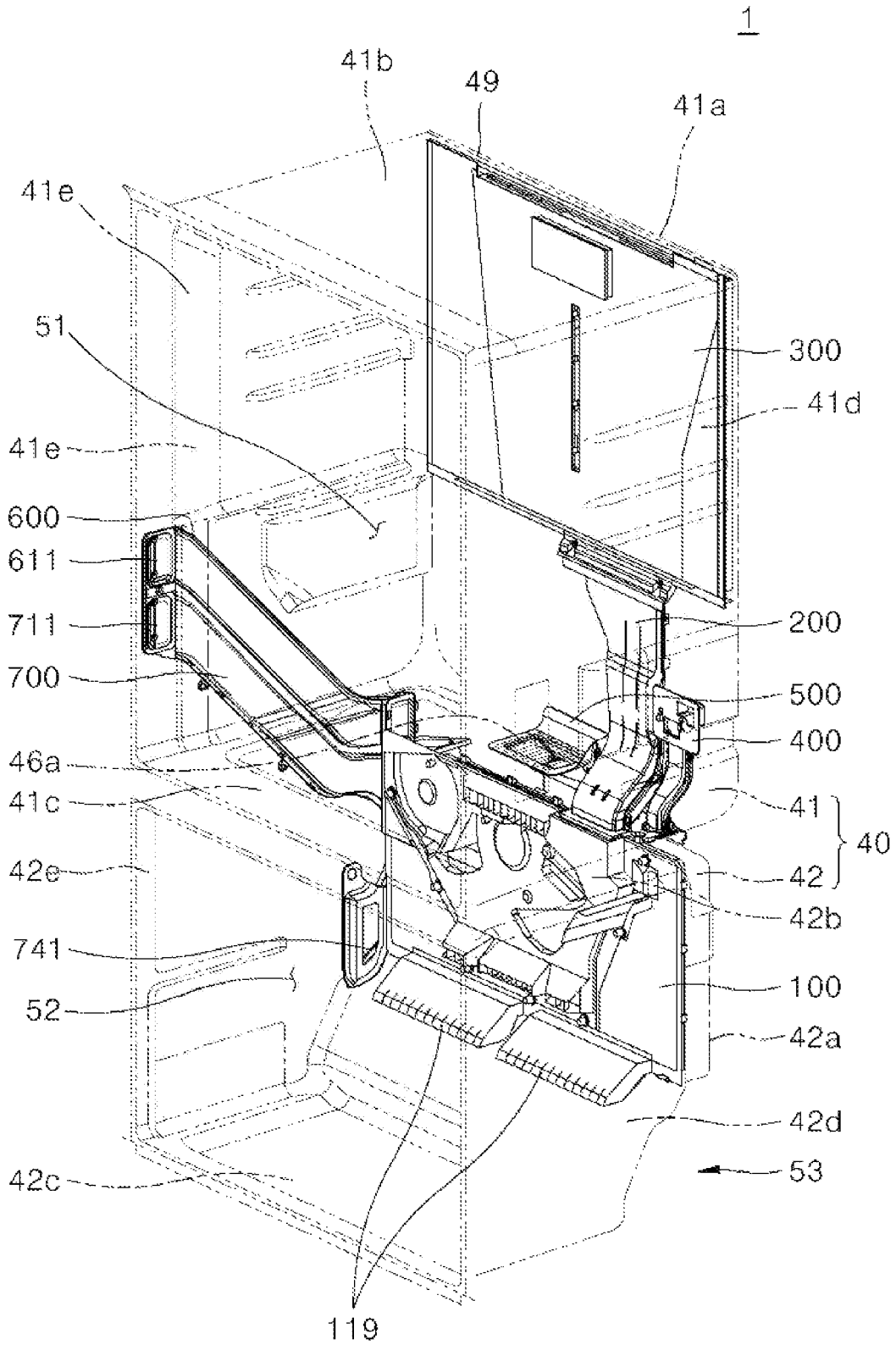
FIG. 3 is a front perspective view showing that an inner case, various types of ducts and a grille fan assembly are coupled in the refrigerator.
Figure 4:
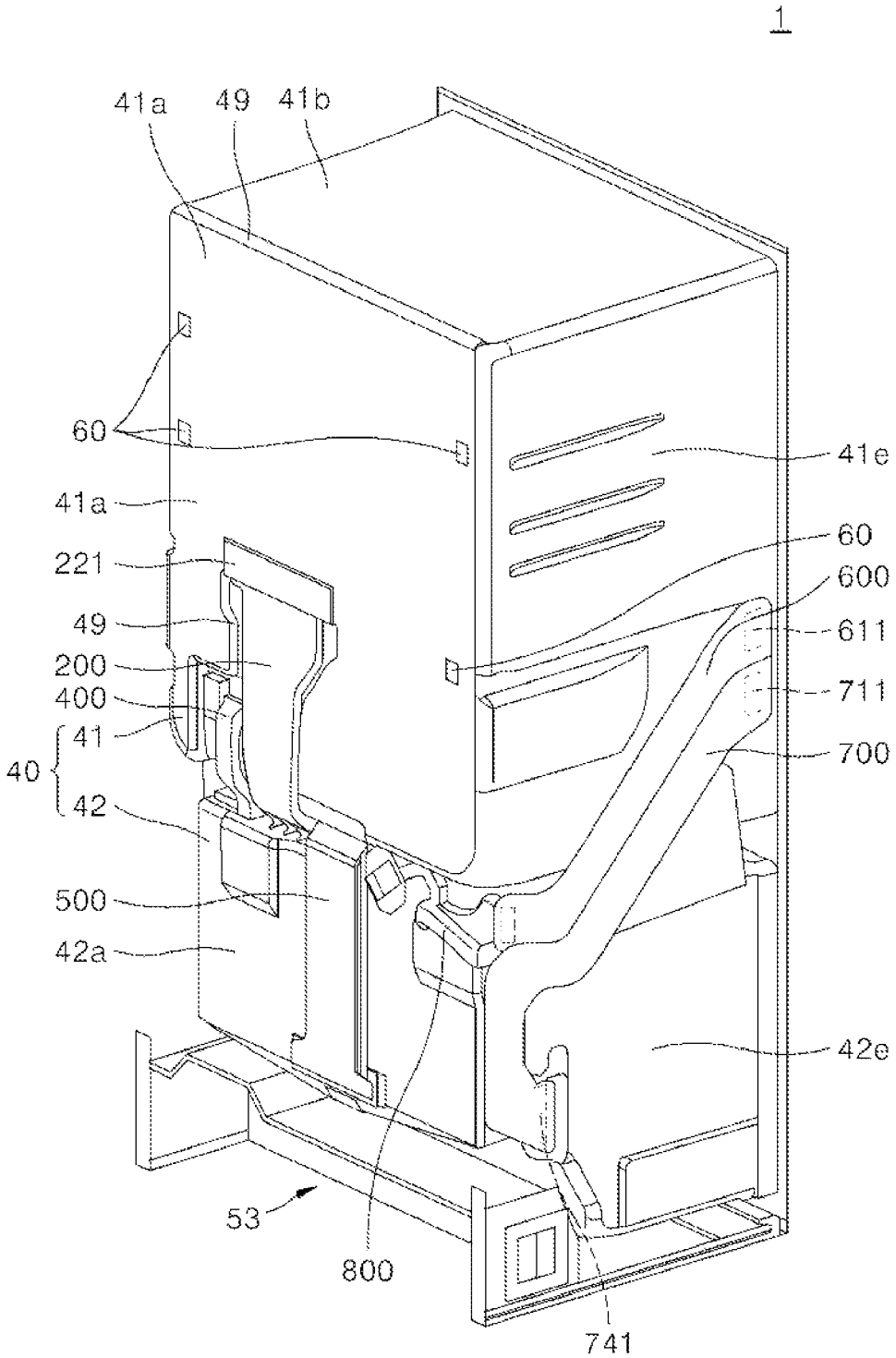
FIG. 4 is a rear perspective view showing that an inner case, various types of ducts and a grille fan assembly are coupled in the refrigerator.
Figure 5:
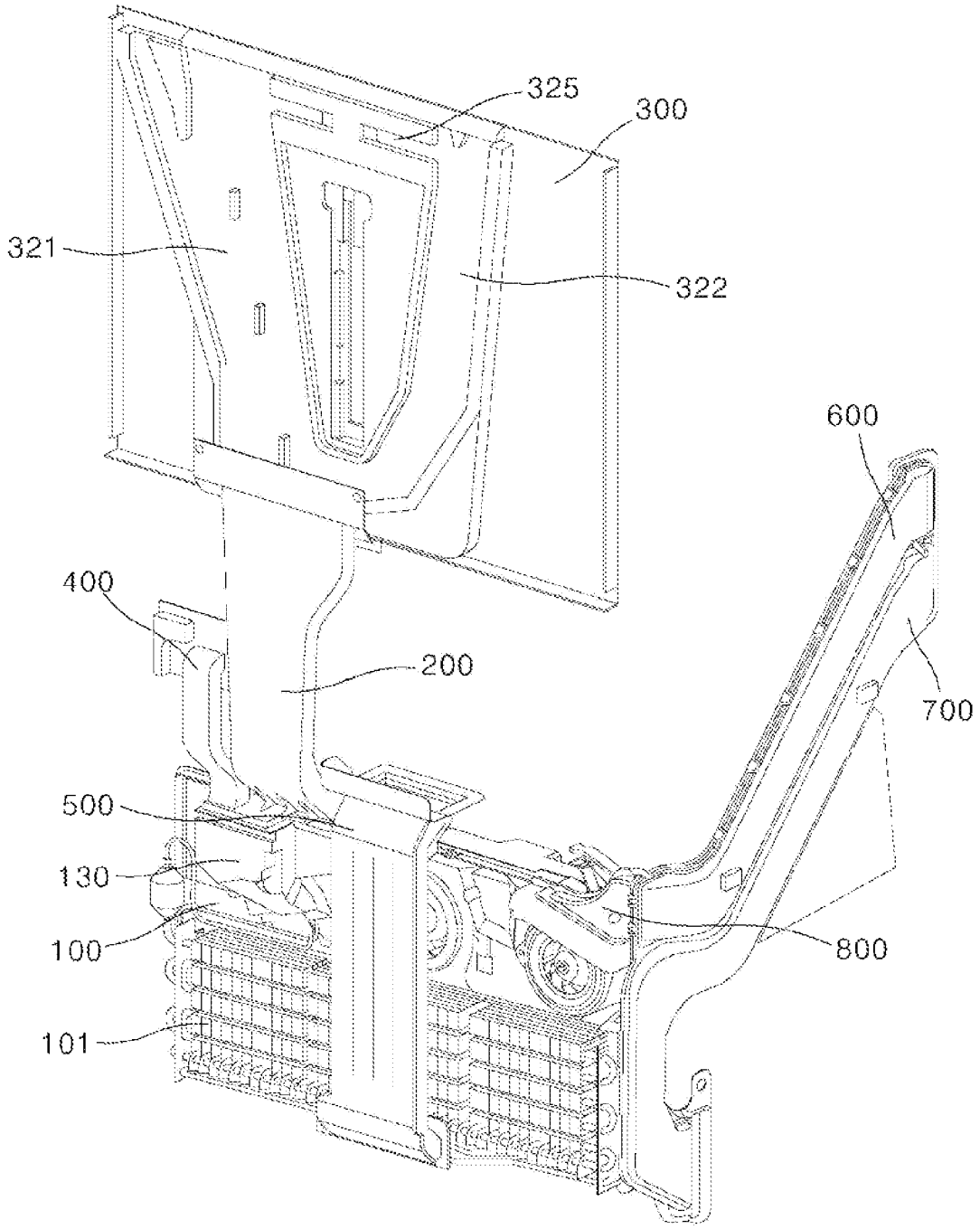
FIG. 5 is a rear perspective view showing that various types of ducts and a grille fan assembly are coupled in the refrigerator.

FIG. 3 is a front perspective view showing that an inner case, various types of ducts and a grille fan assembly are coupled in the refrigerator, FIG. 4 is a rear perspective view showing that an inner case, various types of ducts and a grille fan assembly are coupled in the refrigerator, and FIG. 5 is a rear perspective view showing that various types of ducts and a grille fan assembly are coupled in the refrigerator.

The inner case 40 may be partitioned to comprise a refrigerator case 41 being disposed in the upper portion of the inner case 40 and forming the refrigerator compartment 51, and a freezer case 42 being disposed in the lower portion of the inner case 40 and forming the freezer compartment 52.

Cold air generated in a single evaporator 101 may be supplied to both of the refrigerator compartment 51 and the freezer compartment 52.

If the ice maker 22 is additionally provided at the upper door 20 of the refrigerator 1, cold air generated in a single evaporator 101 may be supplied to all the refrigerator compartment 51, the freezer compartment 52 and the ice maker 22.

The evaporator 101 producing cold air may be disposed at the freezer compartment 52, and specifically, disposed on a rear surface 42*a* of the freezer case, inside the freezer case 42.

The evaporator 101 may be disposed in the upper portion of a machinery room 53.

The machinery room 53 may be provided at the rest side of the lower portion of the freezer case 42, and provide a space for installing a compressor, a condenser, and an expansion side.

The space at the rear of the lower portion side in the freezer compartment 52 may have a freezing space that is less than the space at the rear of the upper portion side in the freezer compartment 52 by the space occupied by the machinery room 53.

That is, an upper surface 42*b* of the freezer case has a surface area that is greater than a lower surface 42*c* of the freezer case.

Accordingly, the area of the upper portion side of the freezer compartment 52 may protrude further rearward than the area of the lower portion side of the freezer compartment 52, and the evaporator 101 may be disposed in the space at the rear of the upper portion side of the freezer compartment 52.

The grille fan assembly 100 may be disposed on the front surface of the evaporator 101, and blow the cold air that is generated by the evaporator to the refrigerator compartment 51 and the freezer compartment 52.

In the case where the ice maker 22 is provided at the upper door 20 of the refrigerator 1, cold air generated from a single evaporator 101 may be blown from a single grille fan assembly 100 to all the refrigerator compartment 51, the freezer compartment 52, and the ice maker 22.

In the refrigerator 1 of the present disclosure, cold air generated from a single evaporator 101 at the freezer compartment 52 may be supplied to the refrigerator compartment 51 as well as the freezer compartment 52.

Accordingly, no space where an additional evaporator 101 is disposed is required in the refrigerator compartment 51, resulting in an increase in the volume of the refrigerator compartment 51.

To blow cold air to a refrigerator compartment supply duct 300 supplying cold air to the refrigerator compartment 51, a connection duct 200 may be additionally disposed between the grille fan assembly 100 and the refrigerator compartment supply duct 300.

One end of the connection duct 200 connects to the grille fan assembly 100, and the other end of the connection duct 200 connects to the refrigerator compartment supply duct 300, such that cold air, being blown from the grille fan assembly 100, is guided to the refrigerator compartment supply duct 300.

The refrigerator compartment supply duct 300 may be disposed inside the refrigerator case 41, the connection duct 200 may be disposed outside the refrigerator case 41, and the refrigerator compartment supply duct 300 and the connection duct 200 may communicate with each other, on a rear surface 41*a* of the refrigerator case.

A foam insulator may foam in the space between the inner case 40 and the outer case 10 and fill the space.

The connection duct 200 may be disposed to pass through the space between the inner case 40 and the outer case 10, which foams with the foam insulator, and buried into the space between the inner case 40 and the outer case 10.

Accordingly, as the upper door 20 of the refrigerator 1 is opened, the connection duct 200 outside the refrigerator case 41 may not be exposed outward, while the refrigerator compartment supply duct 300 inside the refrigerator case 41 may be exposed outward.

A rear surface protrusion part 43 may be disposed on the rear surface 41*a* of the refrigerator case, and protrude toward the inside of the refrigerator case 41, to allow at least a partial area of the connection duct 200 to be inserted from the outside of the refrigerator case 41.

The rear surface protrusion part 43 may have a shape corresponding to the shape of the connection duct 200 such that the connection duct 200 is inserted into the rear surface protrusion part 43.

The rear surface protrusion part 43 may be elongated along the rear surface 41*a* of the refrigerator case toward an upper surface 41*b* of the refrigerator case from a lower surface 41*c* of the refrigerator case.

Since the refrigerator compartment supply duct 300 is disposed inside the refrigerator case 41, the volume of the refrigerator case 41 decreases, as the surface area occupied by the refrigerator compartment supply duct 300 increases.

In particular, since the refrigerator compartment supply duct 300 comprises a cold air flow path through which cold air passes, dew may be formed as cold air passes through the refrigerator compartment 51 having a relatively high temperature and a relatively high humidity. To prevent this from happening, the refrigerator comprises an insulation member of a predetermined thickness.

To increase the volume of the refrigerator case 41, the surface area, occupied by the refrigerator compartment supply duct 300 inside the refrigerator case 41, needs to decrease.

The refrigerator compartment supply duct 300 according to the present disclosure is elongated from the lower surface 41*c* of the refrigerator case to the upper surface 41*b* of the refrigerator case, and is not disposed on the rear surface 41*a* of the refrigerator case.

A rear surface protrusion part 43 is elongated along the rear surface 41*a* of the refrigerator case from the lower surface 41*c* of the refrigerator case toward the upper surface 41*b* of the refrigerator case, up to a predetermined height.

Since the connection duct 200 is disposed on the back surface of the rear surface protrusion part 43, the connection duct 200 is disposed outside the refrigerator case 41, rather than inside the refrigerator case 41.

Accordingly, an additional area protruding toward the inside of the refrigerator case 41 except for the rear surface protrusion part 43 may decrease up to the height at which the rear surface protrusion part 43, into which the connection duct 200 is inserted, is formed, and the volume of the refrigerator case may increase.

The rear surface protrusion part 43 may be elongated up to a height close to the central area with respect to the up-down direction of the refrigerator case 41, but not limited.

For example, the rear surface protrusion part 43 may be elongated from the lower surface 41*c* of the refrigerator case up to the height at which the rear surface protrusion part 43 is covered by the storage drawer 3 disposed in the refrigerator case 41.

Further, the rear surface protrusion part 43 may be also be covered by the second storage compartment 51*b* formed in the lower area of the refrigerator case 41.

Thus, the rear surface protrusion part 43 may be elongated from the lower surface 41*c* of the refrigerator case up to the height at which the rear surface protrusion part 43 is covered by the second storage compartment 51*b* and the storage drawer 3 disposed on the second storage compartment 51*b*.

The rear surface protrusion part 43 is not formed in a way that the area of the rear surface 41*a* of the refrigerator case protrudes evenly, but protrudes to correspond to the connection duct 200, causing deterioration in aesthetic qualities.

The second storage compartment 51*b* and the storage drawer 43 are disposed on the front surface of the rear surface protrusion part 43, up to the height at which the rear surface protrusion part 43 is formed. Thus, even when the upper door 20 is opened, the rear surface protrusion part 43 is not exposed, ensuring improvement in the aesthetic qualities of the inside of the refrigerator 1.

Additionally, since the connection duct 200 is disposed to pass through the space between the inner case 40 and the outer case 10, which foams with the foam insulator, an additional insulation member for preventing the heat exchange between the connection duct 200 through which cold air passes, and the refrigerator compartment 51 may not be required.

For the refrigerator 1 to have an insulation effect, a foam insulator exhibiting a very low thermal conductivity foams between the inner case 40 and the outer case 10, to fill the space between the inner case 40 and the outer case 10.

If the connection duct 200 is disposed inside the refrigerator case 41, an insulation member having a predetermined thickness may insulate the connection duct 200.

However, in one embodiment of the present disclosure, the connection duct 200 may be buried in a way that the connection duct 200 passes through the space between the inner case 40 and the outer case 10, which foams with a foam insulator.

Accordingly, in one embodiment of the present disclosure, an additional insulation member for thermally insulating the connection duct 200 is not required, and a foam insulator foaming between the inner case 40 and the outer case 10 can produce a sufficient insulation effect.

In one embodiment of the present disclosure, an additional insulation member for allowing the connection duct 200 to produce an insulation effect is not required, resulting in a significant reduction in the thickness of the connection duct 200.

Accordingly, the thickness of the rear surface protrusion part 43 protruding toward the inside of the refrigerator case 41 decreases significantly, and the volume of the refrigerator compartment 51 may increase.

In the refrigerator 1, the connection duct 200 and the refrigerator compartment supply duct 300 communicate with each other on the rear surface of the refrigerator case 41, with the refrigerator case 41 therebetween, such that the surface area occupied by the refrigerator compartment supply duct 300 inside the rear surface 41*a* of the refrigerator case decreases.

Thus, the refrigerator 1 may ensure an increase in the volume of the refrigerator compartment 51.

The refrigerator 1 according to the present disclosure may comprise a refrigerator compartment return duct 500 that returns cold air of the refrigerator compartment 51 and supplies the cold air to the evaporator 101.

One end of the refrigerator compartment return duct 500 may connect to the freezer compartment 52, while the other end of the refrigerator compartment return duct 500 connects to the refrigerator compartment 51, and one end and the other end of the refrigerator compartment return duct 500 may be disposed to overlap each other in the up-down direction.

One end of the refrigerator compartment return duct 500 may communicate with the freezer compartment 52 through a refrigerator compartment cold air return communication outlet 46*b* that is disposed on the rear surface 42*a* of the freezer case.

The refrigerator compartment return duct 500 may pass the rear surface of the evaporator 101.

If the refrigerator compartment return duct 500 is too close to the evaporator 101, ice formation may occur. To prevent this from happening, the refrigerator compartment return duct 500 may be spaced a predetermined distance apart from the evaporator 101.

In particular, since the refrigerator compartment return duct 500 comprises a cold air flow path that is used to return cold air of the refrigerator compartment having a relatively high temperature and a relatively high humidity, it is highly likely that ice formation occurs at the refrigerator compartment return duct 500.

To prevent this from happening, one end and the other end of the refrigerator compartment return duct 500 are disposed to overlap each other in the up-down direction, to have the shortest cold air flow path.

Additionally, both side surfaces of the refrigerator compartment return duct 500 have the least curved shapes and are formed into straight lines that are parallel with each other. Accordingly, in terms of the refrigerator compartment return duct 500, the cold air flow path corresponding to the area where the refrigerator compartment return duct 500 overlaps the evaporator 101 may have the shortest length.

Thus, in the refrigerator compartment return duct 500 according to the present disclosure, the cold air flow path overlapping the evaporator 101 has the shortest length, reducing the possibility of ice formation.

Further, the refrigerator compartment return duct 500 according to the present disclosure may make cold air passing through the refrigerator compartment return duct 500 frost evenly rather than being biased by the evaporator 101 to one side, or not frost.

One end and the other end of the refrigerator compartment return duct 500 may be disposed to pass the centers of the refrigerator compartment 51 and the freezer compartment 52 with respect to the left-right direction.

A refrigerator compartment cold air return communication opening 61 is disposed on the lower surface 41*c* of the refrigerator case and communicates with the other end of the refrigerator compartment return duct 500. The refrigerator compartment cold air return communication opening 61 may be disposed to pass the center of the refrigerator compartment 51.

Since one end and the other end of the refrigerator compartment return duct 500 are disposed to pass the centers of the refrigerator compartment 51 and the freezer compartment 52 with respect to the left-right direction, the entire balance of cold air of the refrigerator 1 may be ensured.

The refrigerator compartment return duct 500 returns cold air that is supplied to the refrigerator compartment 51 and circulates in the refrigerator compartment 51, to the freezer compartment 52.

Since the other end of the refrigerator compartment return duct 500, which communicates with the refrigerator compartment cold air return communication opening 61 communicating used to return cold air from the refrigerator compartment 51, is disposed to pass the center of the refrigerator compartment 51, the cold air flows naturally.

The above-described connection duct 200 may be disposed between the refrigerator compartment return duct 500, and the other side surface 41*d* of the refrigerator case that is one side surface of the refrigerator compartment 51, with respect to the left-right direction.

In the case of a connection duct 200 one end of which connects to the freezer compartment 52 and the other end of which connects to the refrigerator compartment 51, the width of the cold air flow path may increase from one end of the connection duct 200 toward the other end of the connection duct 200.

At this time, the width of the cold air flow path of the connection duct 200 may increase further toward the center of the refrigerator compartment 51.

Additionally, the other end of the connection duct 200 may be disposed to pass the center of the refrigerator compartment 51 in the left-right direction.

While the connection duct 200 is disposed between the refrigerator compartment return duct 500 and one side surface of the refrigerator compartment 51, the width of the cold air flow path of the connection duct 200 increases further toward the center of the refrigerator compartment 51. Accordingly, the entire balance of cold air of the refrigerator 1 may be ensured.

Further, since the other end of the connection duct 200 communicates with the refrigerator compartment supply duct 300, the connection duct 200 and the refrigerator compartment supply duct 300 may communicate with each other, at the center of the refrigerator compartment 51.

The refrigerator compartment 51 may be divided into a first storage compartment 51*a* and a second storage compartment 51*b*.

Cold air may be supplied to the second storage compartment 51*b* through a second storage compartment supply duct 400, and the second storage compartment supply duct 400 may be disposed outside the refrigerator case 41.

A foam insulator foams in a space between the inner case 40 and the outer case 10 and fills the space.

The second storage compartment supply duct 400 may be disposed to pass through the space between the inner case 40 and the outer case 10, which foams with the foam insulator, and buried in the space between the inner case 40 and the outer case 10.

Accordingly, as the upper door 20 of the refrigerator 1 is opened, the second storage compartment supply duct 400 disposed outside the refrigerator case 41 may not be exposed outward.

As described above, the rear surface protrusion part 43 protruding toward the inside of the refrigerator case 41 may be disposed on the rear surface 41*a* of the refrigerator case, such that at least a partial area of the connection duct 200 is inserted from the outside of the refrigerator case 41.

In this case, the rear surface protrusion part 43 may be formed to allow the connection duct 200 to be inserted into the rear surface protrusion part 43 as well as allowing at least a partial area of the second storage compartment supply duct 400 to be inserted from the outside of the refrigerator case 4.

The connection duct 200 and the second storage compartment supply duct 400 may be disposed to be adjacent to each other.

For example, the second storage compartment supply duct 400 may be disposed between the connection duct 200, and the other side surface 41*d* of the refrigerator case that is one side surface of the refrigerator compartment 51, with respect to the left-right direction.

Since the second storage compartment supply duct 400 supplies cold air to the second storage compartment 51*b* in a way that the second storage compartment supply duct 400 is inserted from the outside the refrigerator case 41, an area of the second storage compartment 400, protruding toward the inside of the refrigerator compartment 51, may decrease, and the volume of the refrigerator compartment 51 may increase.

Additionally, since the second storage compartment supply duct 400 is disposed to pass through the space between the inner case 40 and the outer case 10, which foams with a foam insulator, an additional insulation member for preventing the heat exchange between the second storage compartment supply duct 400 through which cold air passes and the refrigerator compartment 51 may not be required.

Accordingly, in one embodiment of the present disclosure, a sufficient insulation effect may be produced through the foam insulator that foams between the inner case 40 and the outer case 10 without an additional insulation member for thermally insulating the second storage compartment supply duct 400.

Thus, in one embodiment, since no additional insulation member for providing an insulation effect to the second storage compartment supply duct 400 is required, the thickness of the second storage compartment supply duct 400 may decrease significantly.

Since the thickness of the rear surface protrusion part 43 protruding toward the inside of the refrigerator case 41 decreases significantly, the volume of the refrigerator compartment 51 may increase.

The refrigerator 1 according to the present disclosure may comprise an ice maker 22 at the upper door 20 that opens and closes the refrigerator compartment 51.

Cold air generated from the evaporator 101 may be supplied to the ice maker 22 through an ice maker supply duct 600.

A supply duct inlet 631 may be formed at one end of the ice maker supply duct 600, and communicate with the grille fan assembly 100.

At this time, an ice maker guide duct 800 may be disposed between the ice maker supply duct 600 and the grille fan assembly 100, and allow the ice maker supply duct 600 and the grille fan assembly 100 to communicate with each other.

The ice maker guide duct 800 may change the direction of cold air being discharged from the grille fan assembly 100.

Cold air having circulated in the ice maker 22 may return to the freezer compartment 52 through an ice maker return duct 700.

A return duct outlet 741 may be formed at one end of the ice maker return duct 700, and communicate with the freezer compartment 52.

A return duct inlet 711 may be formed at the other end of the ice maker return duct 700, and communicate with the ice maker 22.

In another example, the ice maker 22 may be dispose at the second upper door 20*b*.

As described above, the upper door 20 comprising the ice maker 22 may be disposed on the front surface of the refrigerator 1.

The ice maker supply duct 600 and the ice maker return duct 700 may be elongated along one side surface 41*e* of the refrigerator case and allow the ice maker 22 and the cold air flow path of the freezer case 42 to communicate with each other.

At this time, one side surface 41*e* of the refrigerator case, passed by the ice maker supply duct 600 and the ice maker return duct 700, may have a relatively low temperature, considering the distribution of the temperature of the entire refrigerator 1.

Accordingly, an imbalance of cold air may occur between one side surface 41*e* of the refrigerator case and the other side surface 41*d* of the refrigerator case.

To reduce the imbalance of cold air in the left-right direction, the connection duct 200 and the second storage compartment supply duct 400 are disposed near the other side surface 41*d* of the refrigerator case, which faces the one side surface 41*e* of the refrigerator case, to ensure a balance of cold air in the entire refrigerator 1.

In relation to this, the refrigerator compartment supply duct 300 may comprise a first refrigerator compartment cold air flow path 321 and a second refrigerator compartment cold air flow path 322 through which cold air guided from the connection duct 200 is branched.

The first refrigerator compartment cold air flow path 321 may have a greater width than the second refrigerator compartment cold air flow path 322, such that more cold air is guided toward the first refrigerator compartment cold air flow path 321.

The second refrigerator compartment cold air flow path 322, to which relatively less cold air is guided, may be disposed closer to one side surface 41*e* of the refrigerator case, where the ice maker supply duct 600 is disposed, than the first refrigerator compartment cold air flow path 321.

Since in the refrigerator compartment supply duct 300, the first refrigerator compartment cold air flow path 321, having a greater width than the second refrigerator compartment cold air flow path 322, is disposed farther from one side surface 41*e* of the refrigerator case where the ice maker supply duct 600 is disposed, a balance of cold air of the entire refrigerator 1 may be ensured.

Further, a flow path opening and closing module 130 may be disposed at the freezer compartment 52, and selectively cut off a supply of cold air generated from the evaporator 101 to the refrigerator compartment 51.

The refrigerator 1 described above may have the following circulation flow of cold air.

Cold air generated from the evaporator 101 in the freezer compartment 52 may be blown to the connection duct 200 that is buried outside the rear surface of the refrigerator compartment 51, by the grille fan assembly 100 disposed at the freezer compartment 52.

The cold air blown to the connection duct 200 may communicate with the refrigerator compartment supply duct 300 disposed inside the rear surface of the refrigerator compartment 51, on the rear surface of the refrigerator compartment 51, and guided to the refrigerator compartment supply duct 300.

The refrigerator compartment supply duct 300 may discharge cold air toward the front surface of the refrigerator compartment 51 in the upper area of the refrigerator compartment 51.

The cold air discharged to the front surface of the refrigerator compartment 51 in the upper area of the refrigerator compartment 51 circulates in the refrigerator compartment 51 and returns to the rear surface of the refrigerator compartment 51 in the lower area of the refrigerator compartment 51.

Since the refrigerator compartment return duct 500 communicates with the lower portion of the rear surface of the refrigerator compartment 51, cold air circulated in the refrigerator compartment 51 may return to the freezer compartment 52 through the refrigerator compartment return duct 500.

Cold air, which is generated from the evaporator 101 disposed at the freezer compartment 52, may be blown to the second storage compartment supply duct 400 buried outside the rear surface of the refrigerator compartment 51, by the grille fan assembly 100 disposed at the freezer compartment 52.

The cold air blown to the second storage compartment supply duct 400 may be discharged to the second storage compartment 51*b*, on the rear surface of the refrigerator compartment 51.

The second storage compartment supply duct 400 may discharge cold air toward the front surface of the second storage compartment 51*b* in the upper area of the second storage compartment 51*b*.

The cold air discharged toward the front surface of the second storage compartment 51*b* in the upper area of the second storage compartment 51*b* circulates in the second storage compartment 51*b* and returns to the rear surface of the second storage compartment 51*b* in the lower area of the second storage compartment 51*b*.

Since the refrigerator compartment return duct 500 communicates with the lower portion of the rear surface of the second storage compartment 51*b*, cold air circulated in the second storage compartment 51*b* may return to the freezer compartment 52 through the refrigerator compartment return duct 500.

A cold air supply duct supplying cold air to the first storage compartment 51*a* and a cold air supply duct supplying cold air to the second storage compartment 51*b* may differ, but cold air having circulated in the first storage compartment 51*a* and cold air having circulated in the second storage compartment 51*b* may both return to the refrigerator compartment return duct 500 that is an identical cold air return duct.

Cold air, which is generated from the evaporator 101 disposed at the freezer compartment 52, may be supplied to the freezer compartment 52, by the grille fan assembly 100 disposed at the freezer compartment 52.

The grille fan assembly 100 may discharge cold air toward the front surface of the freezer compartment 52, in the upper area of the freezer compartment 52.

The cold air discharged toward the front surface of the freezer compartment 52 in the upper area of the freezer compartment 52 circulates in the freezer compartment 52, and returns to the rear surface of the freezer compartment 52, in the lower area of the freezer compartment 52.

Since the machinery room is provided at the rear side of the lower portion of the freezer compartment 52, the rear surface of the lower portion side of the freezer compartment 52 may have an inclined surface that goes upward at a slant.

Accordingly, the cold air returning to the rear surface of the freezer compartment 52, in the lower area of the freezer compartment 52, may be drawn and returned to a freezer compartment cold air return guide part 119 of the grille fan assembly 100 along the inclined surface of the rear surface of the freezer compartment 52.

Figure 10:
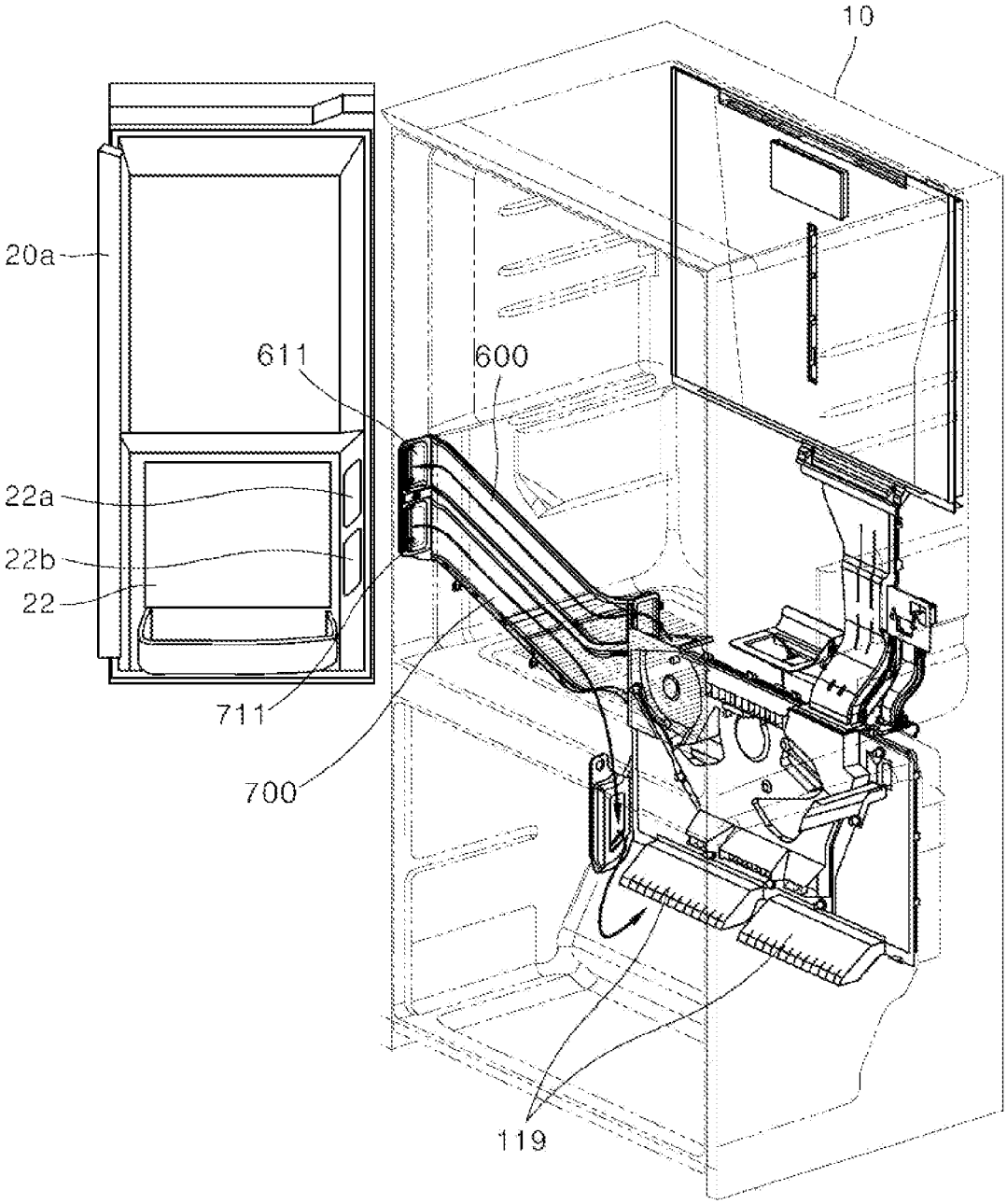
FIG. 10 is a view showing a structure for supplying and returning cold air to the ice maker of the refrigerator.

The flow of the supply and return of cold air to the ice maker 22 is described hereafter, with reference to FIG. 10.

Figure 6:
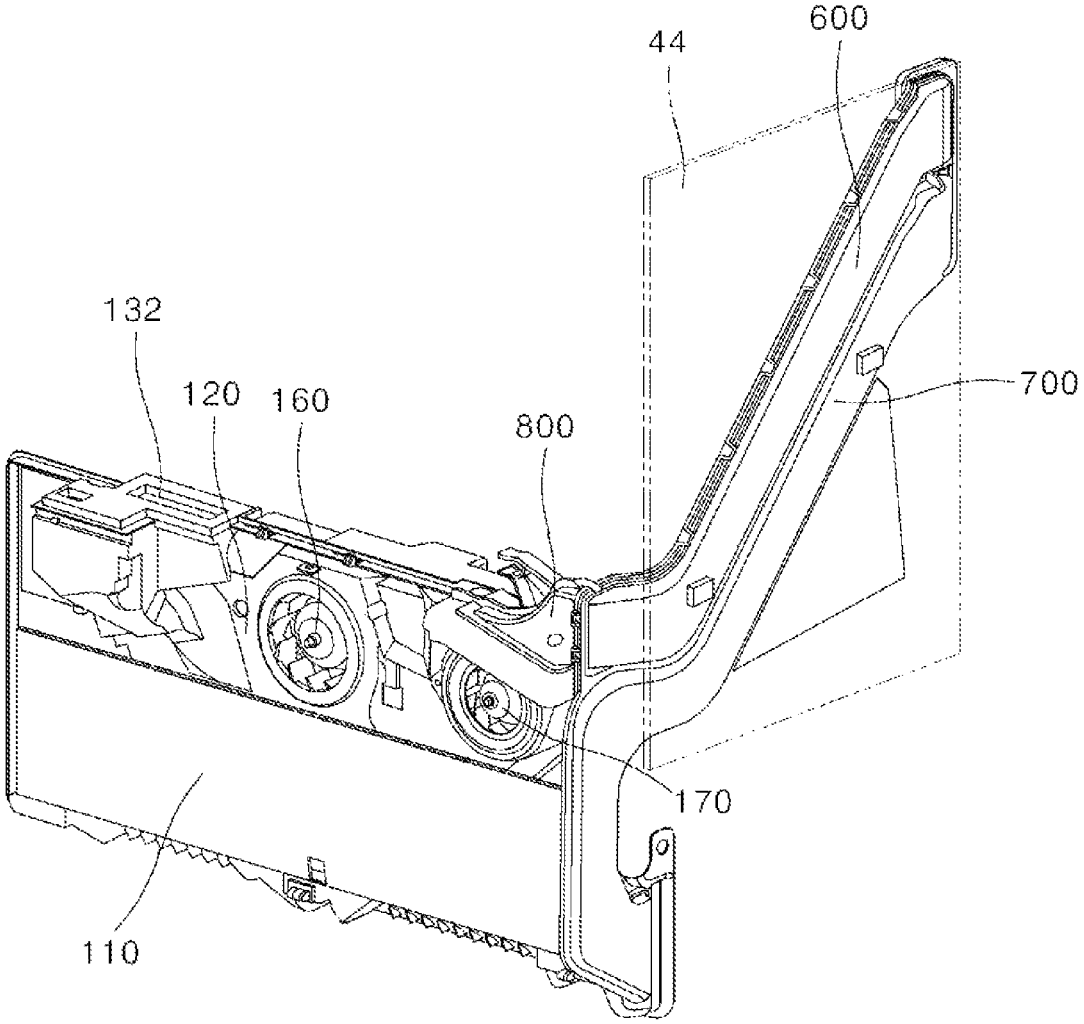
FIG. 6 is a rear perspective view showing that an ice maker supply duct, an ice maker return duct and a grille fan assembly are coupled in the refrigerator.
Figure 7:
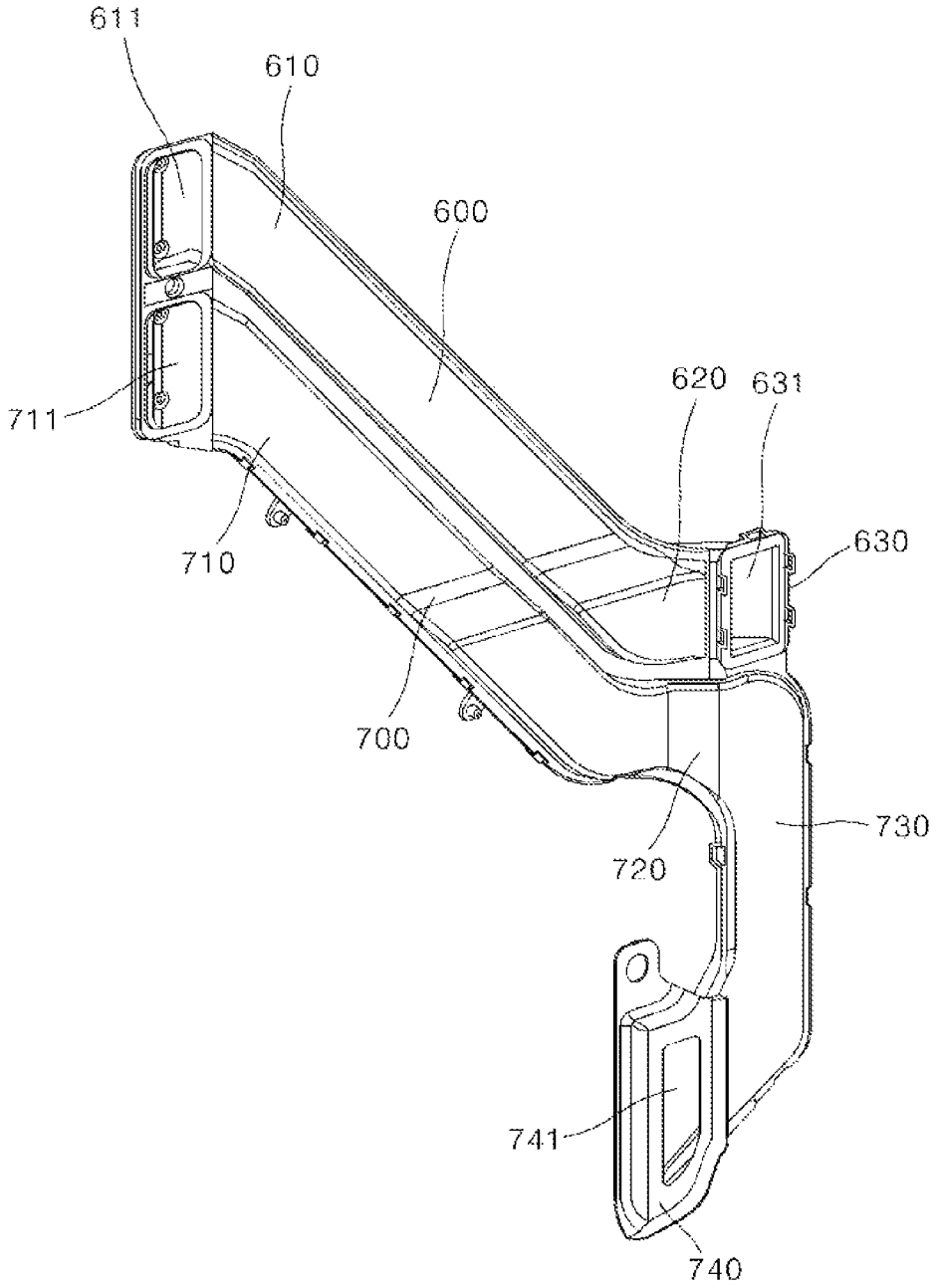
FIG. 7 is a perspective view showing an ice maker supply duct and an ice maker return duct of the refrigerator.
Figure 8:
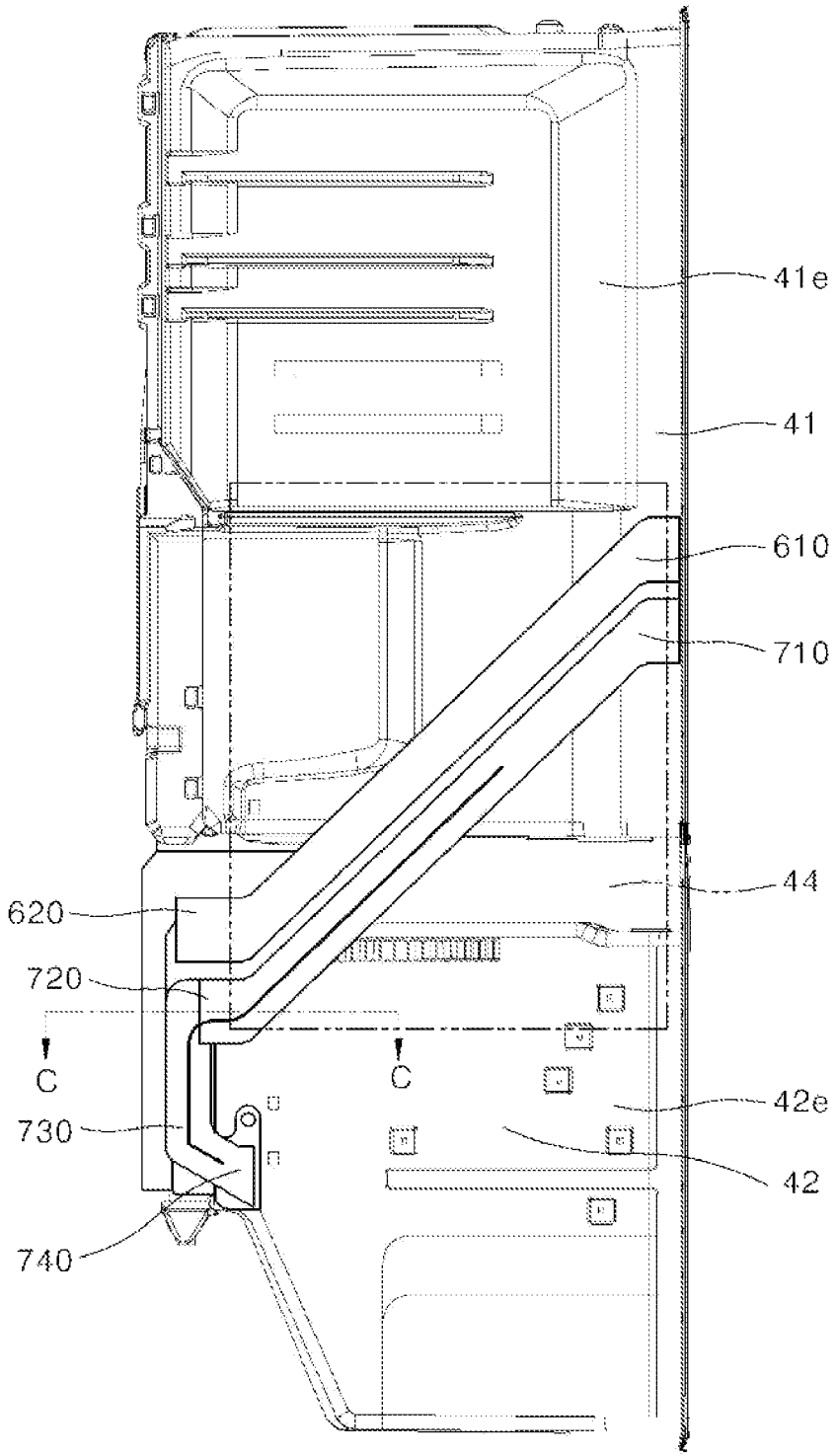
FIG. 8 is a side view showing that an inner case, various types of ducts and a grille fan assembly are coupled in the refrigerator.
Figure 9:
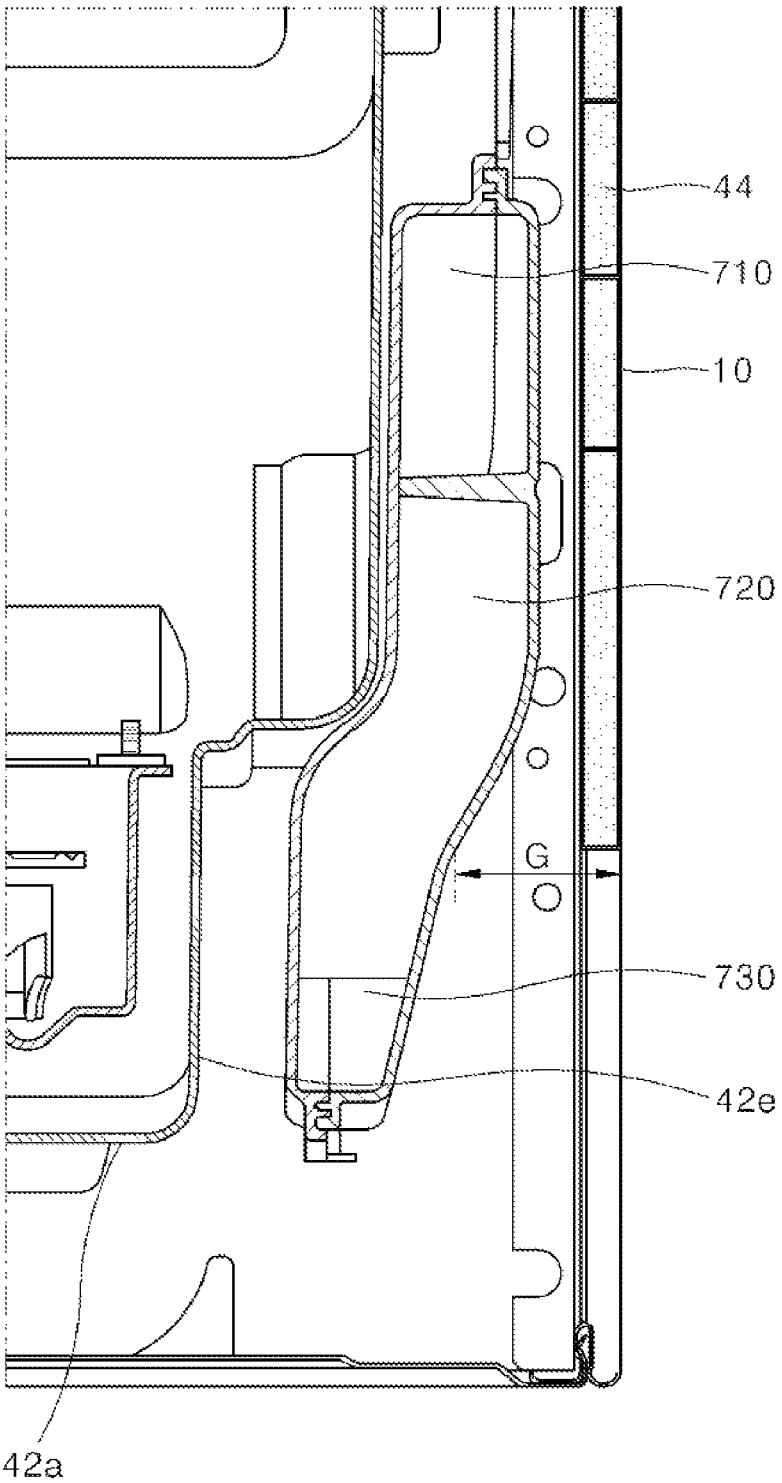
FIG. 9 is a cross-sectional view showing portion C-C of the refrigerator in FIG. 8.

FIG. 6 is a rear perspective view showing that an ice maker supply duct, an ice maker return duct and a grille fan assembly are coupled in the refrigerator, FIG. 7 is a perspective view showing an ice maker supply duct and an ice maker return duct of the refrigerator, FIG. 8 is a side view showing that an inner case, various types of ducts and a grille fan assembly are coupled in the refrigerator, and FIG. 9 is a cross-sectional view showing portion C-C of the refrigerator in FIG. 8.

The refrigerator 1 comprises an outer case 10 forming the exterior of the refrigerator 1, a refrigerator case 41 forming a refrigerator compartment 51, and a freezer case 42 being disposed at the lower side of the refrigerator case 41 and forming a freezer compartment 52, a door 20*a*, 20*b* being disposed at the front of the refrigerator case 41 and opening closing the refrigerator case, an ice maker 22 being disposed at the door 20*a*, 20*b* and generating ice, an evaporator 101 being disposed at the rear of the freezer case 42 and generating cold air, an ice maker supply duct 600 guiding the cold air, generated from the evaporator 101, to the ice maker 22, an ice maker return duct 700 supplying the cold air, supplied to the ice maker 22, to the freezer compartment 52, a grille fan assembly 100 blowing the cold air that is generated from the evaporator 101, an ice maker guide duct 800 connecting to the ice maker supply duct 600 and guiding the cold air that is blown by the grille fan assembly 100 to the ice maker supply duct 600, and a vacuum insulation material 44 being disposed between a portion of the ice maker return duct 700 and the outer case 10 and blocking a heat transfer.

The door 20*a*, 20*b* is one of the first upper door 20*a* and the second upper door 20*b*, and in the embodiment, the door 20*a*, 20*b* is the first upper door 20*a* at which the ice maker 22 is disposed.

The grille fan assembly 100 according to the present disclosure may comprise a shroud 120, a grille fan 110, a freezing fan module 160 and an ice making fan module 170.

The shroud 120 may form the exterior of the rear side of the grille fan assembly 100, and the grille fan 110 may form the exterior of the front side of the grille fan assembly 100.

The grille fan 110 may be disposed toward the front surface of the freezer compartment 52, and the shroud 120 may be disposed toward the evaporator 101 that is disposed on the rear surface 42*a* of the freezer case, i.e., on the wall of the rear side of the freezer case 42.

Cold air blown by the freezing fan module 160 is blown to the refrigerator compartment 51 comprising the first storage compartment 51*a* and the second storage compartment 51*b*, and the freezer compartment 52. Cold air blown by the ice making fan module 170 is blown to the ice maker 22.

The vacuum insulator 44 is an insulator, in which a core (usually, glass fibers) that is a porous filler is put into an encapsulant having airtightness, the inside of which enters into a vacuum state, and which exhibits excellent thermal insulation.

The foam insulator fills the separation space between the outer case 10 and the inner case 40. However, since cold air of a very low temperature flows in the ice maker supply duct 600 and the ice maker return duct 700, and the ice maker supply duct 600 and the ice maker return duct 700 are disposed near the outer case 10, dew may be easily formed at the outer case 10. To prevent this from happening, the vacuum insulator 44, as an insulation member exhibiting a high insulation performance, is disposed between the ice maker supply duct 600 and the ice maker return duct 700, and the outer case 10.

However, an increase in the size of the vacuum insulator 44 raises the possibility of damage to the vacuum, and pushes up the cost of the vacuum insulator. It is preferable to scale down the vacuum insulator 44. Since the vacuum insulator 44 is formed into a rectangular plate to ensure improvement in productivity, it is difficult to manufacture a vacuum insulator 44 having a shape corresponding to the shapes of the ice maker supply duct 600 and the ice maker return duct 700. It is important to optimize the shapes of the ice maker supply duct 600 and the ice maker return duct 700 and to minimize the vacuum insulator 44.

The vacuum insulator 44 is formed into a rectangular thin plate. A portion of the vacuum insulator 44 is disposed between one side surface of the ice maker supply duct 600 and one side surface of the ice maker return duct 700, and one side surface of the outer case 10, and the other portion is disposed between one side surface 41*e* of the refrigerator case and one side surface 42*e* of the freezer case, and one side surface of the outer case 10. The vertical (up-down) length of the vacuum insulator 44 is greater than the horizontal (front-rear) length of the vacuum insulator. The vacuum insulator 44 is substantially parallel with one side surface of the outer case 10.

The upper end of the vacuum insulator 44 is disposed to be substantially aligned with the upper end of the ice maker supply duct 600, and the front end of the vacuum insulator 44 is disposed to be substantially aligned with a portion where the front ends of the ice maker supply duct 600 and the ice maker return duct 700 bend toward the inside of the refrigerator compartment 51 (in a direction farther from the outer case 10).

The rear end of the vacuum insulator 44 is disposed to be substantially aligned with a portion where the front end of the ice maker supply duct 600 and a portion of the ice maker return duct 700 bend toward the inside of the refrigerator compartment 51 (in a direction farther from the outer case 10), and the lower end of the vacuum insulator 44 is disposed to be substantially aligned with the lower end of a portion where the ice maker return duct 700 is disposed diagonally.

Referring to FIG. 9, the vacuum insulator 44 is disposed in a portion where the ice maker supply duct 600 and the ice maker return duct 700 are spaced from the outer case 10 by a predetermined distance G or less. At least one side of the vacuum insulator 44 is disposed in a portion where at least one of the ice maker supply duct 600 and the ice maker return duct 700 bends in a direction farther from the outer case 10 (toward the inside of the refrigerator compartment 51).

The ice maker guide duct 800 connects to the grille fan assembly 100 and the ice maker supply duct 600, and guides cold air that is blown by the grille fan assembly 100 to the ice maker supply duct 600.

The ice maker supply duct 600 connects to the ice maker guide duct 800 and the ice maker 22, and guides cold air, which is generated by the evaporator 101 and blown by the grille fan assembly 100, to the ice maker 22.

The ice maker supply duct 600 is disposed on one side surface 41*e* of the refrigerator case and one side surface 42*e* of the freezer case. The ice maker supply duct 600 may be disposed on the other side surface 41*d* of the refrigerator case and the other side surface 42*d* of the freezer case, depending on the position of the door 20*a*, 20*b* at which the ice maker 22 is disposed.

The ice maker supply duct 600 is formed approximately into a rectangular thin plate. The ice maker supply duct 600 is formed into a plate that is elongated in the lengthwise direction, and disposed diagonally by crossing from the rear of the upper portion of one side surface 42*e* of the freezer case to the front of the middle portion of one side surface 41*e* of the refrigerator case. Since the ice maker supply duct 600 needs to have the shortest distance, the ice maker supply duct 600 is disposed diagonally, preferably. The ice maker supply duct 600 is formed into a rectangular long slit having a cross section where a left-right width is less than an up-down width.

The ice maker supply duct 600 is disposed near a portion of the ice maker return duct 700 side by side. The ice maker supply duct has a supply duct inlet 631, at the rear end of the lower portion thereof, and has a supply duct outlet 611, at the front end of the upper portion thereof. Cold air generated by the evaporator 101 is drawn into the supply duct inlet 631, and the supply duct outlet 611 discharges cold air to the ice maker 22.

Most of the ice maker supply duct 600 is substantially disposed to face the vacuum insulator 44. The ice maker supply duct 600 contacts one side surface 41*e* of the refrigerator case and one side surface 42*e* of the freezer case closely, and is spaced from the vacuum insulator 44.

The upper end of the ice maker supply duct 600 is substantially aligned with the upper end of the vacuum insulator 44 or disposed at the lower side of the vacuum insulator 44, and the front end of the ice maker supply duct is substantially aligned with the front end of the vacuum insulator 44 or disposed at the front of the vacuum insulator 44. The rear end of the ice maker supply duct 600 is substantially aligned with the rear end of the vacuum insulator 44 or disposed at the rear of the vacuum insulator 44, and the lower end of the ice maker supply duct 600 is disposed higher than the lower end of the vacuum insulator 44. The vacuum insulator 44 is not disposed in a portion of the ice maker supply duct 600, which bends and becomes far from the outer case 10.

The ice maker supply duct 600 comprises a supply duct inclination part 610 that has a supply duct outlet 611 discharging cold air to the ice maker 22 and is disposed near a return duct inclination part 710 side by side, a supply duct bend part 620 that connects to the supply duct inclination part 610, bends and is disposed near the return duct bend part 720 side by side, and a supply duct connection part 630 that has a supply duct inlet 631 which connects to the supply duct bend part 620 and into which cold air generated by the evaporator 101 is drawn.

A portion of the supply duct inclination part 610, where the supply duct outlet 611 is formed, bends toward the inside (in a direction farther from the outer case 10) of the refrigerator compartment 51, such that a surface formed by the supply duct outlet 611 is formed in parallel with a surface substantially formed by one side surface 41*e* of the refrigerator case. That is, the supply duct inclination part 610 bends to enable the supply duct outlet 611 to face the other side surface 41*d* of the refrigerator case. The supply duct inclination part 610 is entirely disposed diagonally in the lengthwise direction thereof, and the portion of the supply duct inclination part 610, where the supply duct outlet 611 is formed, is formed in the horizontal direction.

The vacuum insulator 44 is disposed at the supply duct inclination part 610, except for the bent portion of the front end of the supply duct inclination part, where the supply duct outlet 611 is formed in a way that the vacuum insulator 44 is spaced from the supply duct inclination part 610.

The supply duct bend part 620 bends toward the inside of the refrigerator compartment 51 (in a direction farther from the outer case 10). The supply duct bend part 620 is formed in the horizontal direction and bends with respect to the vertical direction.

The vacuum insulator 44 is spaced from a portion of the supply duct bend part 620, to which the supply duct inclination part 610 connects, and is not disposed in a portion of the supply duct bend part 620, to which the supply duct connection part 630 connects. The vacuum insulator 44 is not disposed in a portion of the supply duct bend part 620, which becomes far from the outer case 10.

The supply duct connection part 630 connects to the ice maker guide duct 800. The surface of the supply duct connection part 630, which is formed by the supply duct inlet 631, is formed in parallel with the surface which is substantially formed by one side surface 41*e* of the refrigerator case. That is, the supply duct connection part 630 is formed in a way that the supply duct inlet 631 faces the other side surface 41*d* of the refrigerator case.

The vacuum insulator 44 is not disposed at the supply duct connection part 630.

The ice maker return duct 700 connects to the ice maker 22 and the freezer case 42 and returns cold air of the ice maker 22 to the freezer compartment 52.

The ice maker return duct 700 is disposed on one side surface 41*e* of the refrigerator case and one side surface 42*e* of the freezer case. The ice maker return duct 700 may be disposed on the other side surface 41*d* of the refrigerator case and the other side surface 42*d* of the freezer case, depending on the position of the door 20*a*, 20*b* at which the ice maker 22 is disposed.

The ice maker return duct 700 is formed into a thin plate, and elongated in the lengthwise direction. When viewed laterally, the upper portion of the ice maker return duct 700 is formed diagonally, while the lower portion is formed in a straight line shape.

The upper portion of the ice maker return duct 700 is disposed diagonally by crossing from the rear of the upper portion of one side surface 42*e* of the freezer case to the front of the middle portion of one side surface 41*e* of the refrigerator case. The ice maker return duct 700 needs to have the shortest distance, but the upper portion of the ice maker return duct 700 may only be disposed diagonally to minimize the size of the vacuum insulator 44. The lower portion of the ice maker return duct 700 is elongated and formed from the rear of one side surface 42*e* of the freezer case in the vertical direction. When viewed from above, the ice maker return duct 700 is formed into a fault, in a way that the lower portion of the ice maker return duct 700 bends from the upper portion of the ice maker return duct 700 toward the other side surface 42*d* of the freezer case (the inside of the freezer compartment 52). The lower portion of the ice maker return duct 700 is elongated and formed diagonally to the lower side of the front thereof, at the lower end thereof.

The ice maker return duct 700 is formed into a rectangular long slit having a cross section where a left-right width is less than an up-down width.

A portion of the ice maker return duct 700 is disposed near the ice maker supply duct 600 side by side. The ice maker return duct 700 bends in a portion adjacent to the supply duct inlet 631, to form a fault. The ice maker return duct 700 bends in a portion adjacent to the portion where the ice maker supply duct 600 connects to the ice maker guide duct 800, to form a fault.

The ice maker return duct 700 has a return duct inlet 711 that discharges cold air to the ice maker 22, at the front end of the upper portion thereof, and has a return duct outlet 741 that discharges cold air to the freezer compartment 52, at the front end of the lower portion thereof.

The upper portion of the ice maker return duct 700 is substantially disposed to face the vacuum insulator 44. The ice maker supply duct 600 contacts one side surface 41*e* of the refrigerator case and one side surface 42*e* of the freezer case closely, and the upper portion of the ice maker supply duct 600 is spaced from the vacuum insulator 44.

The upper end of the ice maker return duct 700 is disposed at the lower side of the upper end of the vacuum insulator 44, and the front end of the ice maker return duct 700 is substantially aligned with the front end of the vacuum insulator 44 or disposed at the front of the vacuum insulator 44. The rear end of the ice maker return duct 700 is disposed at the rear of the rear end of the vacuum insulator 44, and the lower end of the ice maker return duct 700 is disposed lower than the lower end of the vacuum insulator 44. The ice maker return duct 700 bends in a portion where the vacuum insulator 44 is not disposed, to form a fault. The ice maker return duct 700 bends toward the inside of the freezer compartment 52, at the rear end of the vacuum insulator 44, to form a fault.

Referring to FIG. 9, the portion (the upper portion) of the ice maker return duct 700, which the vacuum insulator 44 is disposed, is formed closer to the outer case 10 than the portion (the lower portion) of the ice maker return duct 700, where the vacuum insulator 44 is not disposed.

The portion (the upper portion) of the ice maker return duct 700, which the vacuum insulator 44 is disposed, is disposed diagonally by crossing from the rear of one side surface 42*e* of the freezer case to the front of one side surface 41*e* of the refrigerator case, and the portion (the lower portion) where the vacuum insulator 44 is not disposed is disposed vertically at the rear of one side surface 42*e* of the freezer case.

The ice maker return duct 700 comprises a return duct inclination part 710 that has a return duct inlet 711 into which cold air of the ice maker 22 is drawn and is disposed diagonally by crossing from the front of the refrigerator case 41 to the rear of the freezer case 42, a return duct bend part 720 that connects to the return duct inclination part 710 and bends from one side surface 42*e* of the freezer case toward the other side surface 42*d* of the freezer case (the inside of the freezer compartment 52), a return duct vertical part 730 that connects to the return duct bend part 720 and is disposed vertically, and a return duct connection part 740 that has a return duct outlet 741 which connects to the return duct vertical part 730 and which discharges cold air to the freezer compartment.

The return duct inclination part 710 is disposed near the supply duct inclination part 610 side by side. The portion of the return duct inclination part 710, wherein the return duct inlet 711 is formed, bends toward the inside of the refrigerator compartment 51 (in a direction farther from the outer case 10), such that a surface formed by the return duct inlet 711 is formed in parallel with a surface substantially formed by one side surface 41*e* of the refrigerator case. That is, the return duct inclination part 710 bends in a way that the return duct inlet 711 faces the other side surface 41*d* of the refrigerator case. The return duct inclination part 710 is entirely disposed diagonally in the lengthwise direction, and the portion where the return duct inlet 711 is formed is formed in the horizontal direction.

The vacuum insulator 44 is spaced from the return duct inclination part 710 except for the bent portion of the front end of the return duct inclination part, where the return duct inlet 711 is formed. The vacuum insulator 44 is disposed between the return duct inclination part 710 and the outer case 10.

The return duct bend part 720 bends toward the inside of the refrigerator compartment 51 (in a direction farther from the outer case 10). The return duct bend part 720 is formed horizontally, and bends with respect to the vertical direction.

The vacuum insulator 44 is spaced from the portion of the return duct bend part 720, which connects to the return duct inclination part 710. The vacuum insulator 44 is not disposed in the portion of the return duct bend part 720, which connects to the return duct vertical part 730.

Referring to FIG. 9, a distance between the return duct bend part 720 and the outer case 10 increases from the portion that connects to the return duct inclination part 710 toward the portion that connects to the return duct vertical part 730. A distance between the return duct bend part 720 and the outer case 10 increases from the portion where the vacuum insulator 44 is disposed toward the portion where the vacuum insulator 44 is not disposed. The vacuum insulator 44 is disposed in a portion of the return duct bend part 720, where the return duct bend part 720 is spaced from the outer case 10 by a predetermined distance G or less. The vacuum insulator 44 is not disposed in a portion of the return duct bend part 720, where the return duct bend part 720 is spaced from the outer case 10 by greater than the predetermined distance G.

The return duct vertical part 730 is elongated in the vertical direction. When viewed from above, the return duct vertical part 730 is formed into a fault together with the return duct inclination part 710. The vacuum insulator is not disposed between the return duct vertical part 730 and the outer case 10.

Referring to FIG. 6, a distance between the return duct vertical part 730 and the outer case 10 is greater than a distance between the return duct inclination part 710 and the outer case 10. When projected from the front to the rear, the return duct vertical part 730 invades the area of the freezer compartment 52. When viewed from above, the return duct vertical part 730 bends from the return duct inclination part 710 and is formed into a step. When viewed from above, the return duct vertical part 730 is inserted from the return duct inclination part 710.

The return duct connection part 740 is elongated to the lower side of the front of the return duct vertical part 730 diagonally, at the lower end of the return duct vertical part 730. The return duct connection part 740 connects to the refrigerator case 41. A surface formed by the return duct outlet 741 of the return duct connection part 740 is formed in parallel with a surface substantially formed by one side surface 41*e* of the refrigerator case. That is, the return duct connection part 740 is formed in a way that the return duct outlet 741 faces the other side surface 41*d* of the refrigerator case.

The vacuum insulator 44 is disposed at the return duct inclination part 710, but not disposed at the return duct vertical part 730 and the return duct connection part 740.

FIG. 10 is a view showing a structure for supplying and returning cold air to the ice maker of the refrigerator.

Cold air generated from the evaporator 101 may be supplied to the ice maker 22 that is disposed at the first upper door 20*a* disposed on the front surface of the refrigerator 1, through the ice maker supply duct 600.

One end of the ice maker supply duct 600 may communicate with the grille fan assembly 100. The other end of the ice maker supply duct 600 may communicate with the ice maker 22.

Cold air having circulated in the ice maker 22 may return to the freezer compartment 52 through the ice maker return duct 700.

One end of the ice maker return duct 700 may communicate with the freezer compartment 52. The other end of the ice maker return duct 700 may communicate with the ice maker 22.

The ice maker 22's cold air having returned to the freezer compartment 52 may return through the freezer compartment cold air return guide part 119 that is disposed under the lower portion of the grille fan assembly 100 of the freezer compartment 52.

As described above, a cold air supply duct supplying cold air to the freezer compartment 52 and a cold air supply duct supplying cold air to the ice maker 22 are different, but cold air having circulated in the freezer compartment 52 and cold air having circulated in the ice maker 22 may both return to the refrigerator cold air return guide part 119.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

The invention claimed is:

1. A refrigerator, comprising:

a refrigerator case that defines a refrigerator compartment;

a freezer case that is disposed below the refrigerator case and defines a freezer compartment;

a door disposed at a front of the refrigerator case and configured to open and close at least a portion of the refrigerator case;

an ice maker disposed at the door and configured to generate ice;

an evaporator disposed at a rear of the freezer case and configured to generate cold air;

an ice maker supply duct configured to supply the cold air generated by the evaporator to the ice maker;

an ice maker return duct configured to supply the cold air from the ice maker to the freezer compartment, the ice maker return duct extending downward from a front portion of a first side surface of the refrigerator case to a rear portion of a first side surface of the freezer case;

an outer case that defines an exterior of the refrigerator and is disposed outside the refrigerator case and the freezer case, the outer case being spaced apart from the ice maker return duct in a width direction of the refrigerator; and a vacuum insulator disposed between the ice maker return duct and the outer case, wherein the ice maker return duct comprises:

a first portion that extends from the front portion of the first side surface of the refrigerator case toward the rear portion of the first side surface of the freezer case, and a second portion that is disposed below the first portion and extends in a vertical direction from the rear portion of the first side surface of the freezer case, the second portion defining a curved shape that is curved inward relative to the vacuum insulator and the outer case in the width direction toward a second side surface of the freezer case.

2. The refrigerator of claim 1, wherein the ice maker supply duct is disposed at a side of the ice maker return duct and has a supply duct inlet configured to introduce the cold air generated by the evaporator, and wherein the second portion of the ice maker return duct defines the curved shape at a position adjacent to the supply duct inlet.

3. The refrigerator of claim 1, wherein the second portion of the ice maker return duct extends diagonally from a lower end of the ice maker return duct toward a front of the ice maker return duct.

4. The refrigerator of claim 1, further comprising:

a grille fan assembly configured to blow the cold air generated by the evaporator; and an ice maker guide duct connected to the ice maker supply duct and configured to guide the cold air blown by the grille fan assembly to the ice maker supply duct, wherein the second portion of the ice maker return duct defines the curved shape at a position adjacent to a portion of the ice maker supply duct connected to the ice maker guide duct.

5. The refrigerator of claim 1, wherein the vacuum insulator is disposed between the first portion of the ice maker return duct and the outer case, and wherein the second portion of the ice maker return duct defines the curved shape at a position in which the vacuum insulator is not disposed.

6. A refrigerator comprising:

a refrigerator case that defines a refrigerator compartment;

a freezer case that is disposed below the refrigerator case and defines a freezer compartment;

a door disposed at a front of the refrigerator case and configured to open and close at least a portion of the refrigerator case;

an ice maker disposed at the door and configured to generate ice;

an evaporator disposed at a rear of the freezer case and configured to generate cold air;

an ice maker supply duct configured to supply the cold air generated by the evaporator to the ice maker; and an ice maker return duct configured to supply the cold air from the ice maker to the freezer compartment, the ice maker return duct extending downward from a front portion of a first side surface of the refrigerator case to a rear portion of a first side surface of the freezer case, wherein the ice maker return duct comprises:

a first portion that extends from the front portion of the first side surface of the refrigerator case toward the rear portion of the first side surface of the freezer case, and a second portion that is disposed below the first portion and extends in a vertical direction from the rear portion of the first side surface of the freezer case, the second portion defining a curved shape that is curved from the first portion toward a second side surface of the freezer case, wherein the ice maker return duct comprises:

a return duct inclination part that defines a return duct inlet configured to receive the cold air from the ice maker, the return duct inclination part extending from the front portion of the refrigerator case to the rear portion of the freezer case, a return duct bend part that is connected to the return duct inclination part and curved from the first side surface of the freezer case toward the second side surface of the freezer case, a return duct vertical part that is connected to the return duct bend part and extends in the vertical direction, and a return duct connection part that defines a return duct outlet connected to the return duct vertical part and configured to discharge the cold air to the freezer compartment, and wherein a cross-section of the return duct inclination part and the return duct vertical part define the curved shape.

7. The refrigerator of claim 6, wherein the return duct bend part is curved in a horizontal direction and the vertical direction.

8. The refrigerator of claim 6, further comprising:

an outer case that defines an exterior of the refrigerator and surrounds the refrigerator case and the freezer case; and a vacuum insulator disposed between the return duct inclination part and the outer case.

9. The refrigerator of claim 8, wherein the vacuum insulator is not disposed between the return duct vertical part and the outer case.

10. The refrigerator of claim 8, wherein the return duct bend part has (i) a first part connected to the return duct inclination part and (ii) a second part connected to the return duct vertical part, and wherein the vacuum insulator is disposed in the first part of the return duct bend part, and the vacuum insulator is not disposed in the second part of the return duct bend part.

11. The refrigerator of claim 10, wherein a distance between the return duct bend part and the outer case increases from the first part of the return duct bend part toward the second part of the return duct bend part.

12. The refrigerator of claim 8, wherein a distance between the return duct vertical part and the outer case is greater than a distance between the return duct inclination part and the outer case.

13. The refrigerator of claim 6, wherein the ice maker supply duct comprises:

a supply duct inclination part that defines a supply duct outlet configured to discharge the cold air generated by the evaporator to the ice maker, the supply duct inclination part being disposed at a side of the return duct inclination part;

a supply duct bend part connected to the supply duct inclination part, the supply duct bend part being curved and disposed at a side of the return duct bend part; and a supply duct connection part that defines a supply duct inlet connected to the supply duct bend part and configured to receive the cold air generated by the evaporator.

14. A refrigerator, comprising:

an outer case that defines an exterior of the refrigerator;

a refrigerator case that is disposed in the outer case and defines a refrigerator compartment;

a freezer case that is disposed in the outer case and disposed below the refrigerator case, the freezer case defining a freezer compartment;

a door disposed at a front of the refrigerator case and configured to open and close at least a portion of the refrigerator case;

an evaporator disposed at a rear of the freezer case and configured to generate cold air;

an ice maker disposed at the door and configured to generate ice;

an ice maker return duct configured to supply the cold air from the ice maker to the freezer compartment; and a vacuum insulator disposed between the outer case and a first portion of the ice maker return duct, wherein the first portion of the ice maker return duct is disposed closer to the outer case than a second portion of the ice maker return duct in which the vacuum insulator is not disposed.

15. The refrigerator of claim 14, wherein the ice maker return duct is curved from a rear end of the vacuum insulator toward an inside of the freezer compartment.

16. The refrigerator of claim 14, wherein the first portion of the ice maker return duct extends from a rear portion of a first side surface of the freezer case to a front portion of a first side surface of the refrigerator case, and wherein the second portion of the ice maker return duct is disposed at the rear portion of the first side surface of the freezer case and extends in a vertical direction.

17. The refrigerator of claim 14, wherein the ice maker return duct comprises:

a return duct inclination part that defines a return duct inlet configured to receive the cold air from the ice maker, the return duct inclination part extending from a front portion of the refrigerator case to a rear portion of the freezer case;

a return duct bend part that is connected to the return duct inclination part and extends rearward, the return duct bend part being curved in a direction away from the outer case;

a return duct vertical part that is connected to the return duct bend part and extends in a vertical direction; and a return duct connection part that extends forward and defines a return duct outlet connected to the return duct vertical part, the return duct outlet being configured to discharge the cold air to the freezer compartment, and wherein the vacuum insulator is disposed at the return duct inclination part, and the vacuum insulator is not disposed at the return duct vertical part and the return duct connection part.

18. The refrigerator of claim 17, wherein the return duct bend part has (i) a first part connected to the return duct inclination part and (ii) a second part connected to the return duct vertical part, and wherein a distance between the return duct bend part and the outer case increases from the first part of the return duct bend part toward the second part of the return duct bend part.

19. The refrigerator of claim 17, wherein the return duct bend part is curved in a horizontal direction and the vertical direction.

20. The refrigerator of claim 14, wherein the first portion of the ice maker return duct is disposed above the second portion of the ice maker return duct.

* * * * *